US005437341A

United States Patent [19]

Horn et al.

[11] Patent Number: 5,437,341

[45] Date of Patent: Aug. 1, 1995

[54] MULTI-DRILL MOUNTER

[76] Inventors: Jack Horn, 12381 E. 112th Ave., Henderson, Colo. 80640; Jerald Werth, 1093 N. Pond Dr., Brighton, Colo. 80601

[21] Appl. No.: 139,211

[22] Filed: Oct. 20, 1993

[51] Int. Cl.[6] ..... E21B 3/04

[52] U.S. Cl. ..... 175/122; 175/162; 175/195; 175/203; 173/28

[58] Field of Search ..... 175/122, 121, 135, 161, 175/162, 173, 195, 203; 173/28, 29, 24, 26

[56] References Cited

U.S. PATENT DOCUMENTS

| | | | |
|---|---|---|---|
| 3,043,382 | 7/1962 | Meredith . | |
| 3,246,705 | 4/1966 | Chappuis | 173/29 X |
| 3,700,045 | 10/1972 | Coontz | 175/162 X |
| 3,864,793 | 1/1975 | Guest | 24/243 |
| 4,087,010 | 5/1978 | Stormon | 214/145 |
| 4,199,033 | 4/1980 | Van Gundy, Jr. | 173/27 |
| 4,809,788 | 3/1989 | Nelson | 173/28 |
| 4,836,294 | 6/1989 | Bencriscutto | 175/161 X |
| 4,854,814 | 8/1989 | Smith | 414/723 |
| 4,998,590 | 3/1991 | Wells | 175/162 |

OTHER PUBLICATIONS

McMillan Earth Drill–Advertisement, (date unknown).

*Primary Examiner*—Terry Lee Melius
*Attorney, Agent, or Firm*—Rick Martin

[57] ABSTRACT

The multi-drill mounter allows any combination of two jack hammers, drills or augers to be simultaneously mounted on a tractor and the like. A flat back panel supports an upper and lower horizontal track. Upper and lower sliding brackets support a pair of vertical derricks. Each derrick can hold a drilling tool such as a jack hammer. In operation the active drilling tool is hydraulically pushed to the center of the derrick while the inactive drilling tool is moved to the side. The multi-drill mounter can also be tilted to allow the use of an auger for drilling wide holes.

12 Claims, 5 Drawing Sheets

MULTI-DRILL MOUNTER

FIELD OF INVENTION

The present invention relates to auger and drill mounting attachments for bobcats, tractors and the like.

BACKGROUND OF THE INVENTION

Environmental clean up and test procedures for hazardous waste sites often require multiple drill samples. For example a sinker drill (such as a Stanley SK58) may be required to drill a hole up to a hole up to 100 feet deep. Next an auger may be required to drill a 1 foot wide hole up to 60 feet deep in order to construct a monitoring well. These test holes are often required miles from the nearest road which could handle a truck carrying a bobcat mini tractor.

It would normally be necessary to first mount the sinker drill on the bobcat, and then proceed to the test site. Then it would be necessary to return to the truck and dismount the sinker drill. Next the auger would be mounted on the bobcat. Finally the bobcat would be driven back out to the test site. The second trip to the test site would tie up tens of thousands of dollars of equipment plus the wasted time of the bobcat driver.

The only known means to mount drilling equipment on a tractor and the like are means which mount only one tool at a time. Here is a brief summary of the prior art.

U.S. Pat. No. 3,043,382 (1962) to Meredith discloses an earth auger improvement comprising a scraper attachment to push the piled up dirt away.

U.S. Pat. No. 3,864,793 (1975) to Guest discloses a single tool mounting brace which attaches to the front of a digging bucket on earth moving equipment.

U.S. Pat. No. 4,087,010 (1978) to Stormon discloses a single tool mounting brace which attaches to the back of a dipping bucket on earth moving equipment.

U.S. Pat. No. 4,199,033 (1980) to Van Gundy, Jr. discloses a single auger with attachment means for a boom of a backhoe.

U.S. Pat. No. 4,854,814 (1989) to Smith, et al. discloses a quick coupler for a lifting arm.

U.S. Pat. No. 4,998,590 (1991) to Wells discloses a forklift adaptable single horizontal auger and attachment means.

A "McMillan" earth drill attachment is known in the art as single auger mounting device for tractors and the like.

The present invention provides the only known means to mount two independent drilling tools simultaneously on the back of tractor, 4×4 truck or bobcat and the like. Thus, the problem is solved of lost time to the test site when two drills or jack hammers or an auger and a drill are needed. Production time is also saved when two drills are needed even right next to the truck carrying the bobcat. The multi-drill mounter allows setting up the two drills the night before rather than using daylight production time for equipment set up.

SUMMARY OF THE INVENTION

The main object of the present invention is to provide the independent mounting of two drills on a tractor and the like.

Another object of the present invention is to allow each drill to independently slide to the center of the mounter when use of one drill is required.

Another object of the present invention is to allow the mounter to tilt, thereby enabling the use of an auger to drill wide holes.

Another object of the present invention is to provide quick mounting.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1:
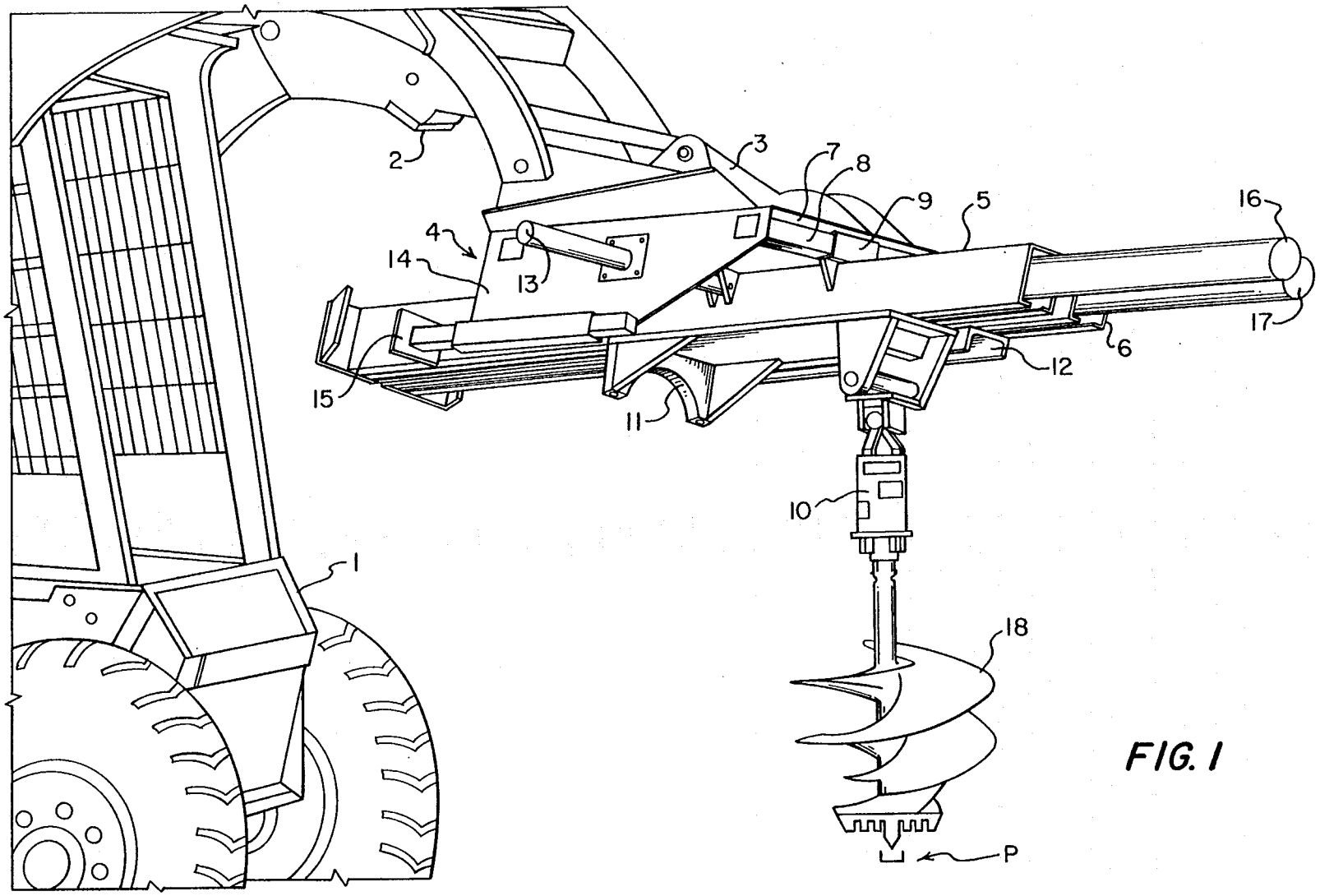
FIG. 1 is a side perspective view of a bobcat with the multi-drill mounter holding an auger in the drill position.

Referring first to FIG. 1 a bobcat 1 has a boom 2. The boom 2 has been moved to hold a mounting platform 3 in a horizontal position a working distance away from bobcat 1. A multi-drill mounter 4 is removably affixed to the mounting platform 3.

The multi-drill mounter 4 has a back plate 7, a right side plate 14, an upper horizontal track 8, an upper horizontal bracket 9, and a derrick 5 affixed to the upper horizontal bracket 9. A hydraulic actuator 13 has moved the derrick 5 to the center of the upper horizontal track 8 so that the auger 10 with blade 18 can be operated. The vertical movement cylinder 16 has been positioned to carry the blade 18 over the desired drilling point P. When the auger 10 is not in use, it can be swung into cradle 11 for storage.

Figure 2:
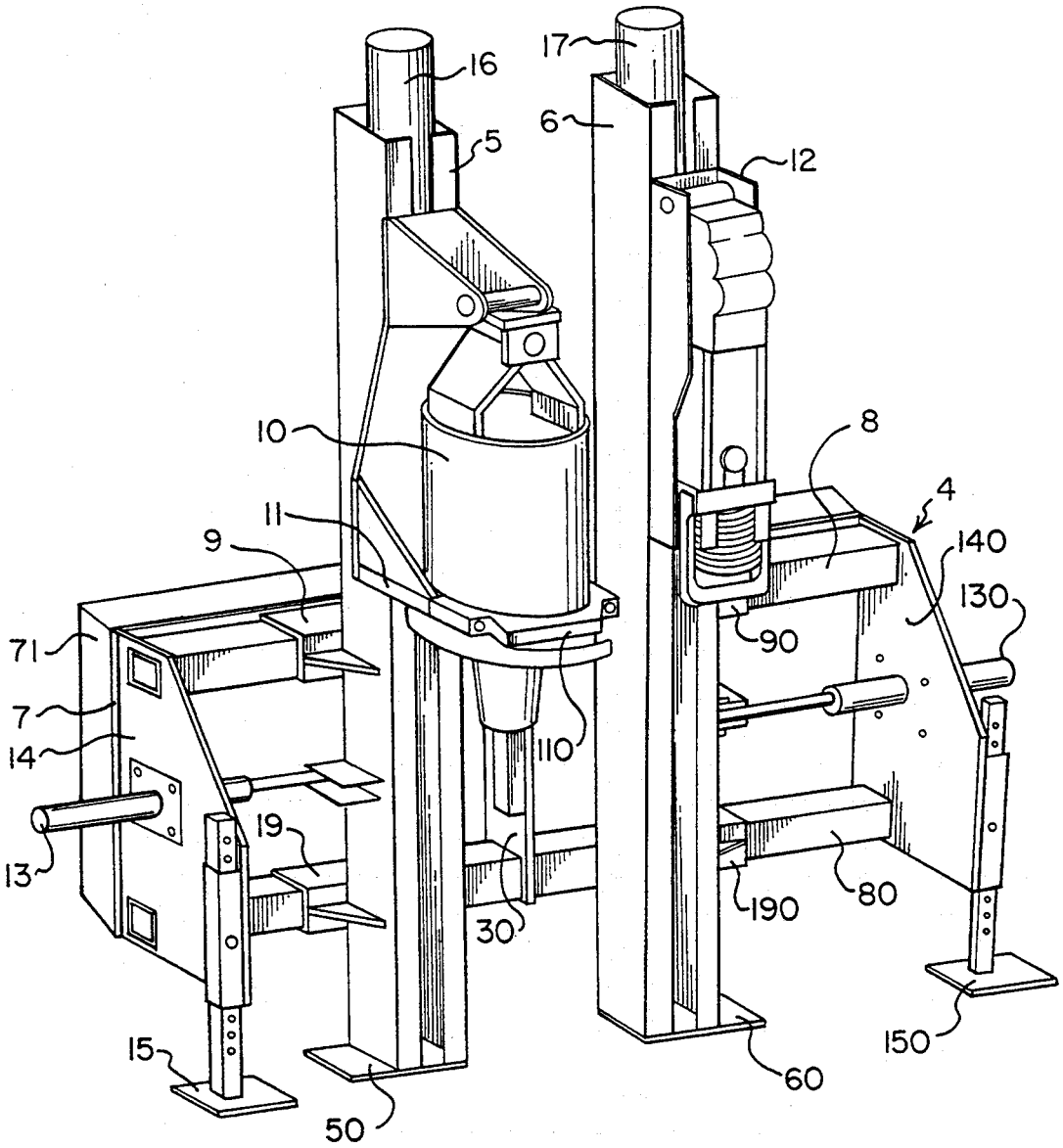
FIG. 2 is a front perspective view of the multi-drill mounter of FIG. 1 in the dismounted position.

A second derrick 6 has a second vertical movement cylinder 17 which is carrying a jack hammer 12 (see also FIG. 2). The jack hammer 12 has been moved to the side in the storage position. The ground stabilizer 15 is used when the multi-drill mounter 4 is used in the vertical position.

Referring next to FIG. 2 the multi-drill mounter 4 is seen dismounted from the bobcat 1 of FIG. 1. It is standing on the derrick feet 50, 60, and the ground stabilizers 15, 150. Auger 10 is locked in cradle 11 by collar 110.

The derricks 5, 6 are supported by the upper horizontal track 8 having upper horizontal brackets 9, 90 and the lower horizontal track 80 having lower horizontal brackets 19, 190. The upper horizontal track 8 and lower horizontal track 80 are mounted in right side plate 14 and left side plate 140. The back plate 7 is made of AR360 and measures about 20"×40". When jack hammer 12 is used the hydraulic actuator 13 moves derrick 5 out of the way next to right side plate 14. Then hydraulic actuator 130 moves derrick 6 against center past 30, thereby stabilizing derrick 6 during operation.

An optional quick connect bonnet 71 is used as the mounting means for the multi-drill mounter 4. Many design choices exist for mounting the 800 pound multi-drill mounter 4 to various tractor rigs including simply bolting it.

Figure 3:
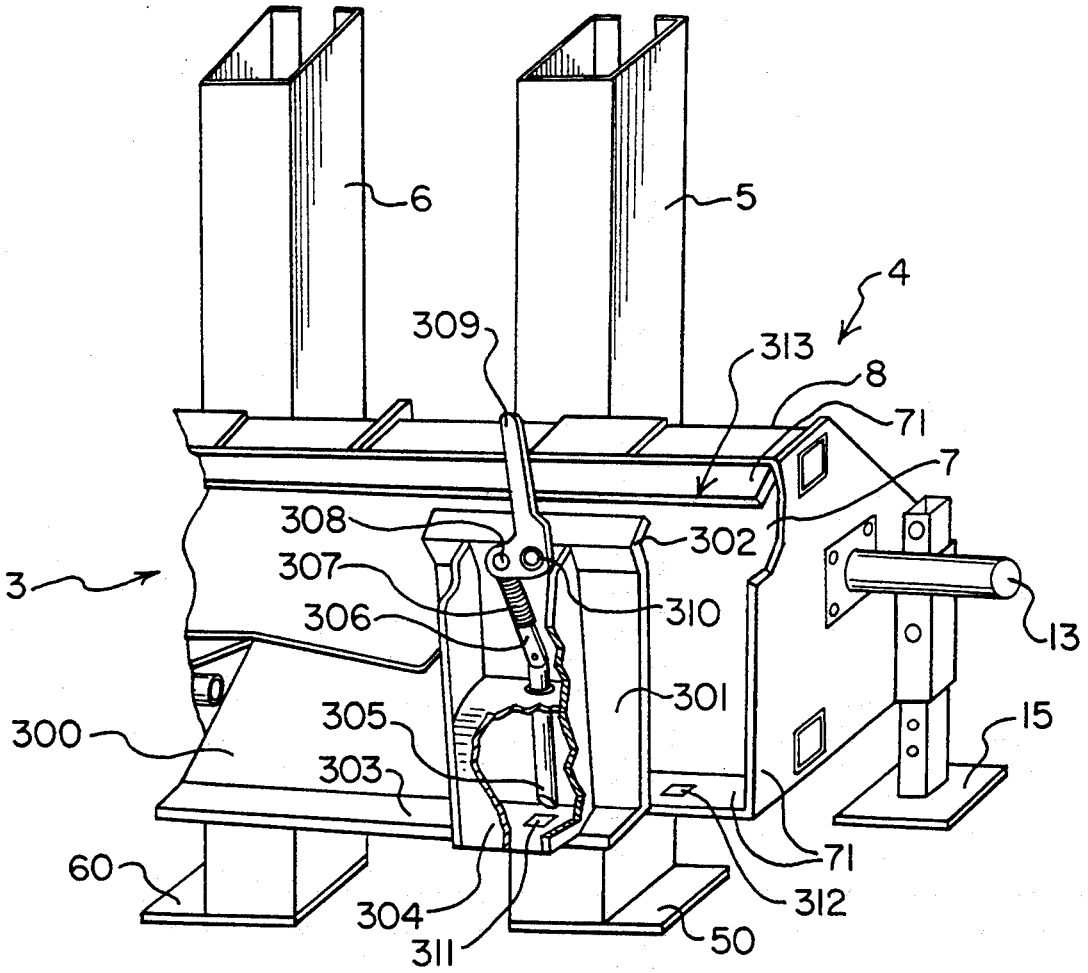
FIG. 3 is a rear perspective view of the multi-drill mounter of FIGS. 1, 2 with a partial cutaway of the bobcat mounting platform and the quick connect bonnet.

Referring next to FIG. 3 the mounting platform 3 of FIG. 1 is about to hitch up to the multi-drill mounter 4. The quick connect bonnet 71 extends from the back plate 7. The hole 312 is ready to receive locking bolt 305.

The mounting platform 3 further comprises a front plate 300 which supports the vertical panel 301. Like members on the opposite side are not shown. The vertical panel 301 has a bottom sill with a hole 311 which aligns with hole 312. The vertical panel 301 also has a support notch 302 which fittingly engages quick connect bonnet 71 along ridge 313. Once the alignment of holes 311, 312 is complete, then cam handle 309 is manually pushed down, thereby pushing cam end 308 against linkage arm 306. Linkage arm 306 thus pushes locking bolt 305 into aligned holes 311, 312. Spring 307 maintains the locking bolt 305 in the locked position. The housing 304 supports the locking bolt 305.

Figure 4:
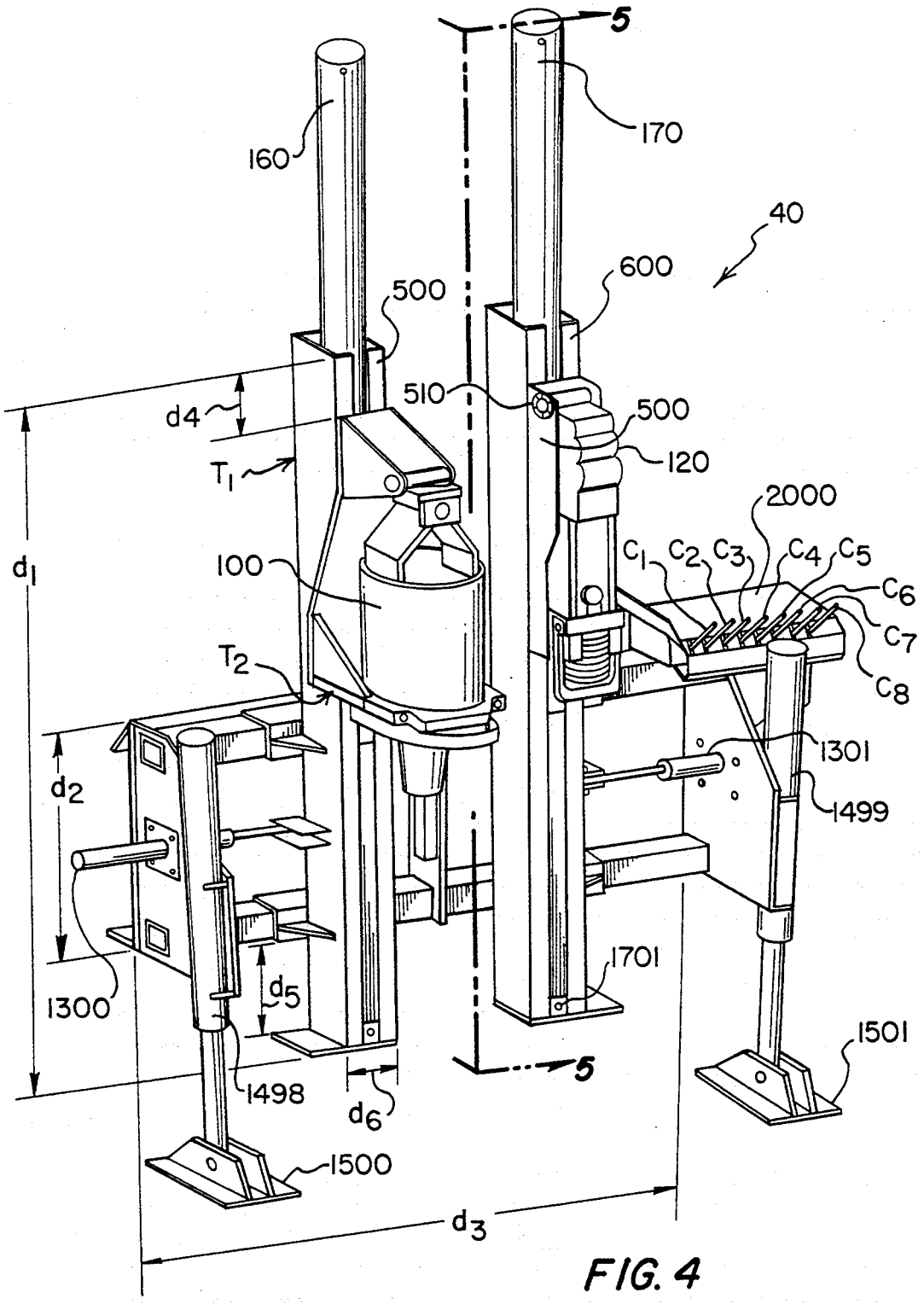
FIG. 4 is a front perspective view of a multi-drill mounter having hydraulic ground stabilizers and a control panel.

Referring next to FIG. 4 a multi-drill mounter 40 has hydraulic ground stabilizers 1500, 1501 which are powered by hydraulic actuators 1498, 1499. An on board control panel 2000 has control levers C1–C8 to control each facet of the multi-drill mounter as defined in the key below. Nominal dimensions d1–d6 are also included in the key below.

In operation the bottom of the outer bracket of the auger 100 at T2 can be raised to level T, on the derrick 5000.

Figure 5:
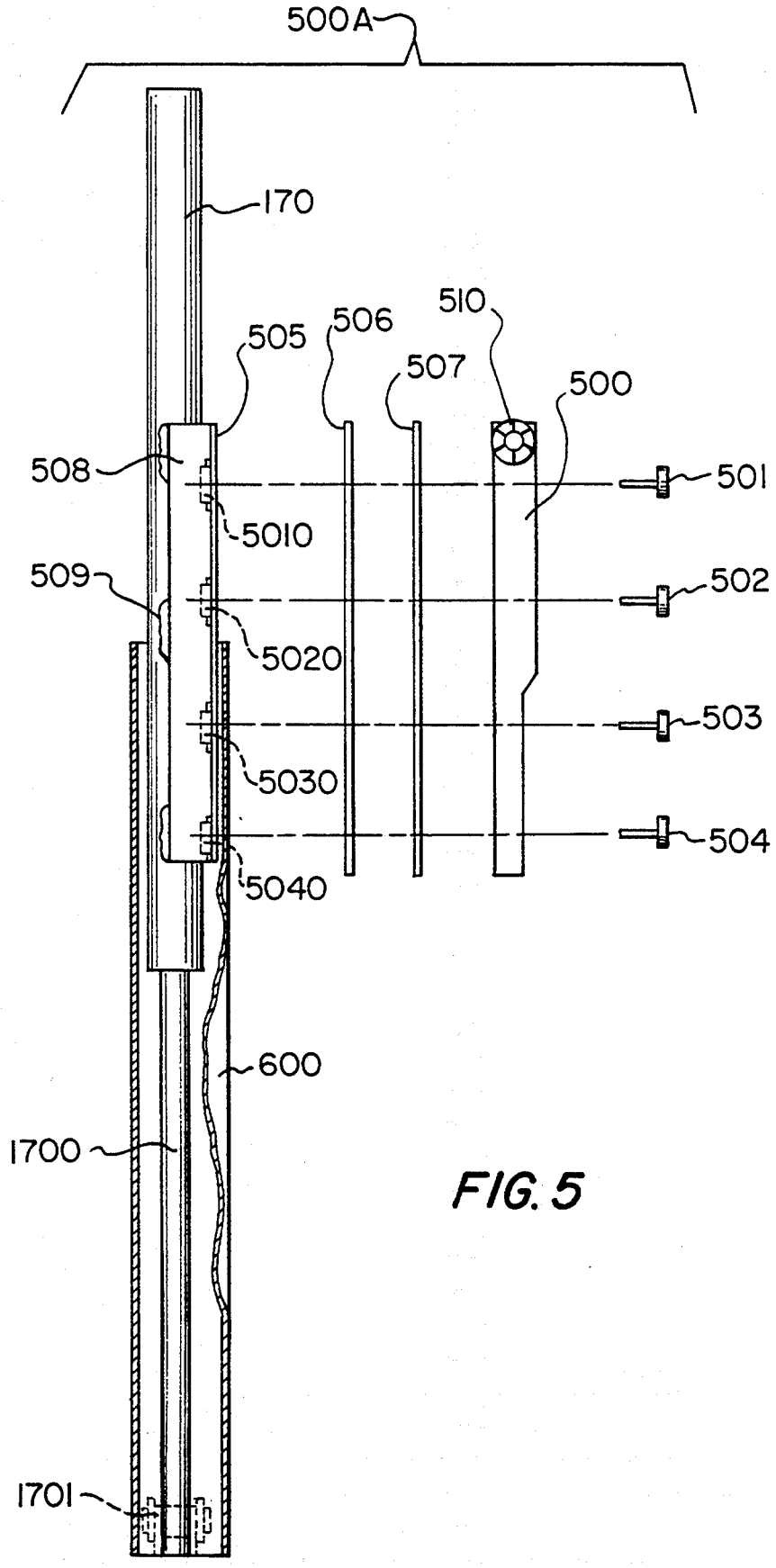
FIG. 5 is an exploded view of the jackhammer mounting assembly taken along line 5—5 of FIG. 4. The derrick is shown in partial cutaway.

Referring last to FIG. 5 an exploded view of the jackhamer mounting assembly 500A is shown. The jackhammer 120 is not shown. The actuator rod 1700 is removably fastened to the derrick 600 with the actuator rod anchor 1701. The vertical movement cylinder 170 can move vertically inside derrick 600. Cylinder bracket welds 509 hold the cylinder bracket 508 against the inner derrick bushing 505. The inner derrick bushing 505 in turn pushes against the slot filter bushing 506. The jackhamer mounting bracket 500 is pulled against the outer derrick bushing 507 by means of bolts 501–504 and nuts 5010–5040. A mounting bolt 510 holds the jackhamer 120 in place.

| KEY | |
|---|---|
| 1 | bobcat |
| 2 | boom |
| 3 | mounting platform |
| 4 | multi-drill mounter |
| 5, 5000, 6, 600 | derricks |
| 7 | back plate |
| 8 | upper horizontal track |
| 9, 90 | upper horizontal brackets |
| 10, 100 | auger |
| 11 | cradle |
| 12 | jack hammer |
| 12, 120 | jackhammer |
| 13, 1300, 1301 | hydraulic actuator |
| 14 | right side plate |
| 15, 150 | ground stabilizers |
| 16, 17, 160, 170 | vertical movement cylinders |
| 19, 190 | lower horizontal brackets |

-continued

| KEY | |
|---|---|
| 30 | center post |
| 40 | multi-drill mounter with hydraulic ground stabilizers |
| 50, 60 | derrick feet |
| 71 | quick connect bonnet |
| 80 | lower horizontal track |
| 110 | collar |
| 130 | hydraulic actuator |
| 140 | left side plate |
| 300 | front plate |
| 301 | vertical panel |
| 302 | support notch |
| 303 | bottom sill |
| 304 | housing |
| 305 | locking bolt |
| 306 | linkage arm |
| 307 | spring |
| 308 | cam end |
| 309 | cam handle |
| 310 | pivot |
| 311, 312 | hole |
| 313 | ridge |
| 500 | jackhammer mounting bracket |
| 500A | jackhammer mounting assembly |
| 501, 502, 503, 504 | bracket bolts |
| 505 | inner derrick bushing |
| 506 | slot filler bushing |
| 507 | outer derrick bushing |
| 508 | cylinder bracket |
| 509 | cylinder bracket weld |
| 510 | mounting bolt |
| 1498, 1499 | hydraulic actuators |
| 1500, 1501 | hydraulic ground stabilizers |
| 1700 | actuator rod |
| 1701 | actuator rod anchor |
| 2000 | control panel |
| 5010, 5020, 5030, 5040 | bracket nuts |
| C1 | right (#1500) hydraulic ground stabilizer up/down control |
| C2 | right (#1300) hydraulic actuator left/right control |
| C3 | right (#160) vertical movement cylinder up/down control |
| C4 | auger (#100) forward/reverse control |
| C5 | left (#170) vertical movement cylinder |
| C6 | jackhammer (#120) control |
| C7 | left (#1301) hydraulic actuator left/right control |
| C8 | left (#1501) hydraulic ground stabilizer up/down control |
| d1 | =72" |
| d2 | =20" |
| d3 | =44.5" |
| d4 | =6" |
| d5 | =10" |
| d6 | =5" SQUARE |
| P | drilling point on ground |
| T1 | upper limit of bottom of outer bracket of tool |
| T2 | bottom of outer bracket of tool |

Although the present invention has been described with reference to preferred embodiments, numerous modifications and variations can be made and still the result will come within the scope of the invention. No limitation with respect to the specific embodiments disclosed herein is intended or should be inferred.

I claim:

1. A multi tool mounter for attaching two earth working tools to a mounting platform on an earth working machine, comprising:

a backplate having removable mounting means to the mounting platform;

said backplate further comprising means for supporting an upper and a lower horizontal track;

a first pair of sliding brackets mounted on said upper and lower horizontal tracks;

a second pair of sliding brackets mounted on said upper and lower horizontal tracks;

said first pair of sliding brackets supporting a first vertical derrick;

said second pair of sliding brackets supporting a second vertical derrick;

means to alternately center the first and second vertical derrick on said backplate; and said first and second vertical derrick each further comprising mounting means for an earth working tool.

2. The mounter of claim 1 wherein said removable mounting means further comprises a bonnet on said backplate fittingly engaged with a front plate on said mounting platform.

3. The mounter of claim 2 wherein said front plate further comprises a locking bolt removably engaged in said bonnet.

4. The mounter of claim 1 wherein said means for supporting an upper and a lower horizontal track further comprises a left and a right side plate projecting outwards from the sides of the backplate.

5. The mounter of claim 4 wherein said means to alternately center the first and second vertical derrick further comprises a first hydraulic actuator on the left side plate having a horizontal actuating rod affixed to the first derrick, and a second hydraulic actuator on the right side plate having a horizontal actuating rod affixed to the second derrick, and a center post in the center of the backplate functioning to stabilize either the first or second derrick when centered.

6. The mounter of claim 1 wherein said mounting means for an earth working tool further comprises a vertical casing having a forward slot, said vertical casing having bolt attachments for a vertical movement cylinder which carries the earth working tool to a desired position along the vertical slot.

7. A mounter for removably attaching a first and a second earth working tool to a tractor and the like, comprising:

a tractor mounting platform;

a mounter backplate removably affixed to the tractor mounting platform;

an upper and a lower horizontal track affixed to said mounter backplate;

a first derrick having a first sliding means on said upper and lower horizontal tracks;

a second derrick having a second sliding means on said upper and lower horizontal tracks;

means to alternately center the first and second derricks on said upper and lower horizontal tracks; and said first and second derrick each having mounting means for the first and second earth working tool respectively.

8. The mounter of claim 7 wherein said first sliding means further comprise an upper bracket and a lower bracket affixed to said first derrick, and said second sliding means further comprise an upper bracket and a lower bracket affixed to said second derrick.

9. The mounter of claim 7 wherein said means to alternately center the first and second derricks further comprise a left and right side panel each having a horizontal actuator functioning to alternately push the first and second derrick against a center post.

10. The mounter of claim 7 wherein said derrick mounting means further comprises a vertical casing having a forward slot, said vertical casing having bolt attachments for a vertical movement cylinder which carries the earth working tool to a desired position along the vertical slot.

11. The mounter of claim 7 wherein said tractor mounting platform further comprises a plate having a vertical panel and a locking bolt for locking to the mounter backplate.

12. The mounter of claim 11 wherein the mounter backplate further comprises a bonnet fittingly engaged in the vertical panel.

* * * * *